United States Patent [19]

Harandi

[11] Patent Number: 5,000,837

[45] Date of Patent: Mar. 19, 1991

[54] MULTISTAGE INTEGRATED PROCESS FOR UPGRADING OLEFINS

[75] Inventor: Mohsen N. Harandi, Lawrenceville, N.J.

[73] Assignee: Mobil Oil Corporation, New York, N.Y.

[21] Appl. No.: 339,466

[22] Filed: Apr. 17, 1989

[51] Int. Cl.[5] ..... C10G 57/02

[52] U.S. Cl. ..... 208/67; 208/71; 208/164; 208/147; 208/149

[58] Field of Search ..... 585/330; 208/49, 67, 208/71, 164, 147, 149

[56] References Cited

U.S. PATENT DOCUMENTS

| | | | |
|---|---|---|---|
| 2,403,268 | 7/1946 | Davis et al. | 208/71 |
| 2,416,022 | 2/1947 | Schulze et al. | 260/671 |
| 2,995,611 | 8/1961 | Linn et al. | 260/671 |
| 3,758,403 | 9/1973 | Rosinski et al. | 208/120 |
| 3,856,659 | 12/1974 | Owen | 208/80 |
| 3,891,540 | 6/1975 | Demmel et al. | 208/77 |
| 3,894,931 | 7/1975 | Nace et al. | 208/73 |
| 3,894,935 | 7/1975 | Owen | 208/78 |
| 3,907,663 | 9/1975 | Owen | 208/70 |
| 3,974,062 | 8/1976 | Owen et al. | 208/74 |
| 4,012,455 | 3/1977 | Owen et al. | 260/668 |
| 4,035,285 | 7/1977 | Owen et al. | 208/120 |
| 4,090,949 | 5/1978 | Owen et al. | 208/78 |
| 4,100,218 | 7/1978 | Chen et al. | 208/71 |
| 4,227,992 | 10/1980 | Garwood et al. | 208/71 |
| 4,309,279 | 1/1982 | Chester et al. | 208/120 |
| 4,606,810 | 8/1986 | Krambeck et al. | 208/74 |
| 4,822,477 | 4/1989 | Auidan et al. | 208/164 |
| 4,855,524 | 8/1989 | Harande et al. | 585/533 |

FOREIGN PATENT DOCUMENTS

| | | |
|---|---|---|
| 0113180 | 7/1984 | European Pat. Off. . |
| 0202000 | 11/1986 | European Pat. Off. . |

*Primary Examiner*—Patrick P. Garvin
*Assistant Examiner*—George R. Fourson
*Attorney, Agent, or Firm*—Alexander J. McKillop; Charles J. Speciale; L. G. Wise

[57] ABSTRACT

An improvement in gasoline octane without substantial decrease in overall yield is obtained in an integrated process combining a fluidized catalytic cracking reaction and a low severity fluidized catalyst olefin oligomerization reaction when crystalline medium pore shape selective zeolite catalyst particles are withdrawn in partially deactivated form from the oligomerization reaction stage and added as part of the active catalyst in the FCC reaction.

15 Claims, 1 Drawing Sheet

MULTISTAGE INTEGRATED PROCESS FOR UPGRADING OLEFINS

BACKGROUND OF THE INVENTION

This invention relates to a catalytic technique for cracking heavy petroleum stocks and upgrading light olefin gas to heavier olefinic hydrocarbons. In particular, it provides a continuous integrated process for oligomerizing olefinic light gas byproduct of cracking to produce $C_5$+ hydrocarbons, such as olefinic gasoline or high quality distillate. Ethene, propene and/or butene containing gases, byproducts of petroleum cracking in a fluidized catalytic cracking (FCC) unit, may be upgraded by contact with a crystalline medium pore siliceous zeolite catalyst.

Developments in zeolite catalysis and hydrocarbon conversion processes have created interest in utilizing olefinic feedstocks for producing $C_5$+ gasoline, diesel fuel, etc. In addition to basic chemical reactions promoted by zeolite catalysts having a ZSM-5 structure, a number of discoveries have contributed to the development of new industrial processes. These are safe, environmentally acceptable processes for utilizing feedstocks that contain lower olefins, especially $C_2$–$C_4$ alkenes. Conversion of $C_2$–$C_4$ alkenes and alkanes to produce aromatics-rich liquid hydrocarbon products were found by Cattanach (U.S. Pat. No. 3,760,024) and Yan et al (U.S. Pat. No. 3,845,150) to be effective processes using the zeolite catalysts having a ZSM-5 structure. U.S. Pat. Nos. 3,960,978 and 4,021,502 (Plank, Rosinski and Givens) disclose conversion of $C_2$–$C_5$ olefins, alone or in admixture with paraffinic components, into higher hydrocarbons over crystalline zeolites having controlled acidity. Garwood et al. have also contributed to the understanding of catalytic olefin upgrading techniques and improved processes as in U.S. Pat. Nos. 4,150,062, 4,211,640 and 4,227,992. The above-identified disclosures are incorporated herein by reference.

Conversion of lower olefins, especially propene and butenes, over HZSM-5 is effective at moderately elevated temperatures and pressures. The conversion products are sought as liquid fuels, especially the $C_5$+ aliphatic and aromatic hydrocarbons. Product distribution for liquid hydrocarbons can be varied by controlling process conditions, such as temperature, pressure, catalyst activity and space velocity. Gasoline ($C_5$–$C_{10}$) is readily formed at elevated temperature (e.g., up to about 400° C.) and moderate pressure from ambient to about 5500 kPa, preferably about 250 to 2900 kPa. Olefinic gasoline can be produced in good yield and may be recovered as a product or fed to a low severity, high pressure reactor system for further conversion to heavier distillate-range products.

Recently it has been found that olefinic light gas can be upgraded to liquid hydrocarbons rich in olefins or aromatics by catalytic conversion in a turbulent fluidized bed of solid medium pore acid zeolite catalyst under effective reaction severity conditions. Such a fluidized bed operation typically requires oxidative regeneration of coked catalyst to restore zeolite acidity for further use, while withdrawing spent catalyst and adding fresh acid zeolite to maintain the desired average catalyst activity in the bed. This technique is particularly useful for upgrading FCC light gas, which usually contains significant amounts of ethene, propene, $C_1$–$C_4$ paraffins and hydrogen produced in cracking heavy petroleum oils or the like.

Economic benefits and increased product quality can be achieved by integrating the FCC and oligomerization units in a novel manner. It is the primary object of this invention to eliminate the olefins upgrading catalyst regeneration system which results in significant process investment saving and improved process safety. Another object of this invention is to eliminate the olefins upgrading spent catalyst stripper which results in significant process investment/operating cost saving. Another object of the present invention is to further extend the usefulness of the medium pore acid zeolite catalyst used in the olefinic light gas upgrading reaction by withdrawing a portion of partially deactivated and coked zeolite catalyst and admixing the withdrawn portion with cracking catalyst in a primary FCC reactor stage. Prior efforts to increase the octane rating of FCC gasoline by addition of zeolites having a ZSM-5 structure to large pore cracking catalysts have resulted in a small decrease in gasoline yield, increase in gasoline quality, and increase in light olefin byproduct.

SUMMARY OF THE INVENTION

It has been discovered that overall gasoline octane rating can be increased with little or no loss in net gasoline yield in an integrated fluidized catalytic cracking (FCC)—olefins oligomerization process when partially deactivated catalyst is transferred from an olefins oligomerization unit to a continuously operated FCC riser reactor stage. The partially deactivated catalyst, preferably a solid medium pore siliceous acidic zeolite catalyst which is compatible with the FCC catalyst inventory, is preferably added directly to the FCC cracking zone.

A continuous multi-stage process has been designed for increasing the octane and the yield of liquid hydrocarbons from an integrated fluidized catalytic cracking unit and olefins oligomerization reaction zone comprising the steps of: contacting heavy hdrocarbon feedstock in a primary fluidized bed reaction stage with cracking catalyst comprising particulate solid large pore acid aluminosilicate zeolite catalyst at conversion conditions to produce a hydrocarbon effluent comprising gas containing $C_2$–$C_6$ olefins, intermediate hydrocarbons in the gasoline and distillate range, and cracked bottoms; regenerating primary stage zeolite cracking catalyst in a primary stage regeneration zone and returning at least a portion of regenerated zeolite cracking catalyst to the primary reaction stage; separating primary stage effluent to recover olefinic gas containing $C_2$–$C_6$ olefins; reacting at least a portion of the olefinic gas in a secondary fluidized bed reactor stage in contact with a closed fluidized bed of acid zeolite catalyst particles consisting essentially of medium pore shape selective zeolite under low severity oligomerizaton reaction conditions to effectively convert $C_2$–$C_6$ olefins to heavier hydrocarbons boiling in the gasoline and/or distillate range; adding fresh acid medium pore zeolite particles to the secondary stage reactor in an amount sufficient to maintain average equilibrium catalyst particle activity for effective oligomerization reaction without regeneration of the secondary catalyst bed; withdrawing a portion of equilibrium catalyst from the secondary fluidized bed reactor stage; and passing said withdrawn catalyst portion to the primary fluidized bed reaction stage for contact with the petroleum feedstock.

DESCRIPTION OF THE DRAWINGS

It has been found that an olefins oligomerization process can be advantageously operated at low severity to produce highly olefinic $C_5+$ hydrocarbons which can be directly blended into gasoline or upgraded into distillate over zeolite catalyst at high operating pressure. The reaction coke make is generally less than 0.1% of olefins feed and preferably less than 0.02 wt. % of olefins feed. Considering the low coke make and low operating temperature (preferably below about 370° C./700° F.) the catalyst deactivation rate is very slow. To further limit catalyst deactivation the olefinic feed is water washed, preferably using the FCC wash water makeup to remove the feed contaminants such as basic nitrogen compounds. Therefore the makeup rate to maintain a low catalyst activity required for the low severity operation is very low. By not regenerating the spent catalyst and sending it unstripped to the FCC reactor where the entrained hydrocarbons are recovered significant investment and operating cost savings are realized. The spent catalyst coke content is preferably kept below 5 wt. % by adjusting the makeup and withdrawal rates. The coke is a relatively soft coke and may be partially cracked in the FCC unit to high quality products. The rest of the coke is burned in the FCC regenerator.

Elimination of the olefin oligomerization regeneration and striping system is particularly advantageous for high pressure operation where regeneration and stripping is very costly.

Figure 1:
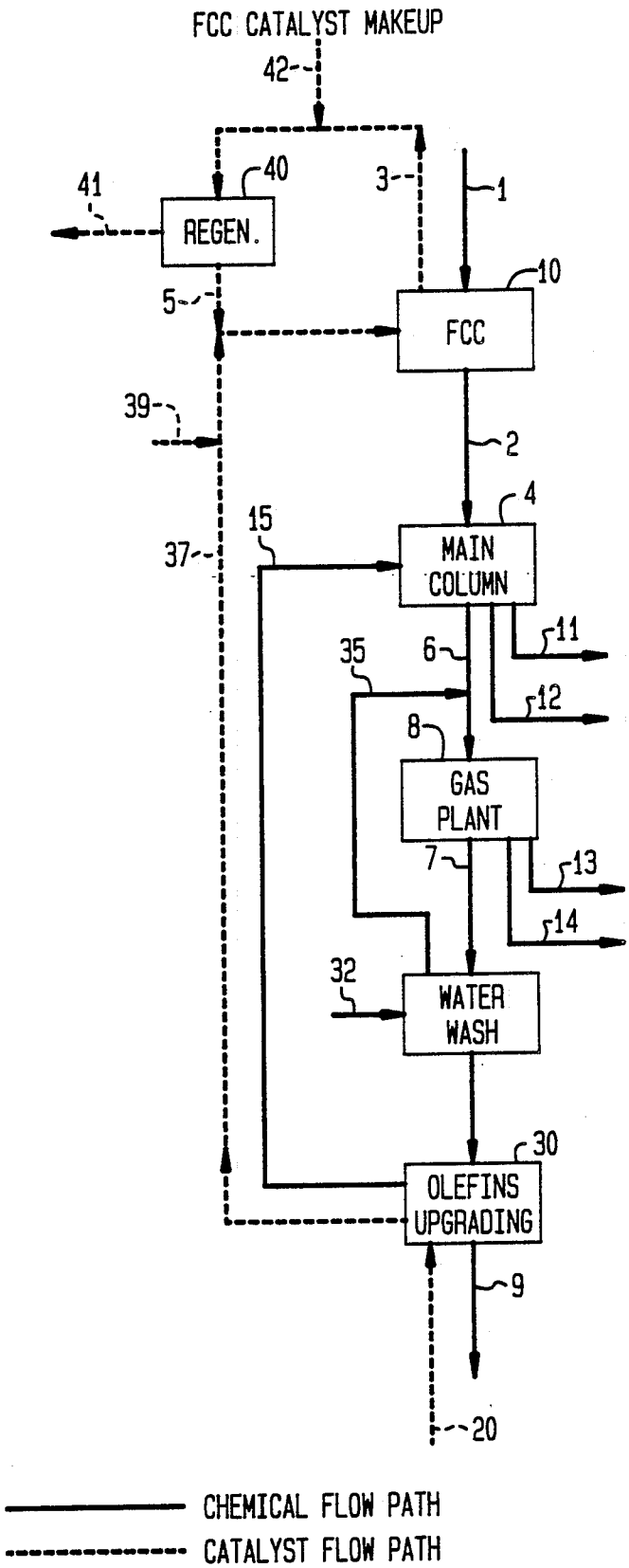

The present process allows for an extended use of the zeolite oligomerization catalyst which would otherwise be unsuitable for further use in the olefin upgrading unit due to insufficient acidity. The partially spent zeolite catalyst from the olefins oligomerization unit, with or without coke, is an excellent gasoline octane booster for an FCC unit because of increased alkylate production. When partially deactivated zeolite catalyst is added to the standard FCC catalyst inventory in minor amounts, the integrated FCC - olefins oligomerization process is optimized to produce high octane $C_5+$ gasoline.

THE DRAWING

FIG. 1 is a schematic representation of an integrated system and process depicting a primary stage fluidized catalytic cracking zone and a secondary stage olefins oligomerization zone. The flow of chemicals is designated by solid lines and the flow of catalyst is designated by broken lines.

DESCRIPTION OF THE INVENTION

In this description, metric units and parts by weight are employed unless otherwise stated.

The present invention provides a continuous multistage process for producing liquid hydrocarbons from a relatively heavy hydrocarbon feedstock. This technique comprises contacting the feedstock in a primary fluidized bed reaction stage with a mixed catalyst system which comprises finely divided particles of a first large pore cracking catalyst component and similar size particles of a second medium pore siliceous zeolite catalyst component under cracking conditions to obtain a product comprising lower boiling hydrocarbons including intermediate gasoline, distillate range hydrocarbons, and lower olefins. The lower olefins are separated from the heavier products and contacted in a secondary fluidized bed reaction stage with medium pore siliceous zeolite catalyst under low reaction severity conditions effective to upgrade at least a portion of the lower molecular weight olefins to olefinic $C_5+$ hydrocarbons. This results in depositing carbonaceous material onto the solid catalyst, which is allowed to build up on the catalyst so that the coke on the catalyst is up to 5 wt. %. Catalyst is continuously or batch wise made up and withdrawn to maintain the required catalyst activity. The withdrawn spent catalyst is sent to the primary fluid bed reaction zone as an octane enhancer.

Because the olefins upgrading reaction severity can be adjusted by other variables than catalyst activity including WHSV, temperature and/or pressure, the catalyst makeup of a primary stage CC unit and a secondary stage olefins conversion unit can thus be balanced.

Fluidized Catalytic Cracking-FCC Reactor Operation

In conventional fluidized catalytic cracking processes, a relatively heavy hydrocarbon feedstock, e.g., a gas oil, is admixed with hot cracking catalyst, e.g., a large pore crystalline zeolite such as zeolite Y, to form fluidized suspension. A fast transport bed reaction zone produces cracking in an elongated riser reactor at elevated temperature to provide a mixture of lighter hydrocarbon crackate products. The gasiform reaction products and spent catalyst are discharged from the riser into a solids separator, e.g., a cyclone unit, located within the upper section of an enclosed catalyst stripping vessel, or stripper, with the reaction products being conveyed to a product recovery zone and the spent catalyst entering a dense bed catalyst regeneration zone within the lower section of the stripper. In order to remove entrained hydrocarbon product from the spent catalyst prior to conveying the latter to a catalyst regenerator unit, an inert stripping gas, e.g., steam, is passed through the catalyst where it desorbs such hydrocarbons conveying them to the product recovery zone. The fluidized cracking catalyst is continuously circulated between the riser and the regenerator and serves to transfer heat from the latter to the former thereby supplying the thermal needs of the cracking reaction which is endothermic.

Particular examples of such catalytic cracking processes are disclosed in U.S. Pat. Nos. 3,617,497, 3,894,932, 4,309,279 and 4,368,114 (single risers) and U.S. Pat. Nos. 3,748,251, 3,849,291, 3,894,931, 3,894,933, 3,894,934, 3,894,935, 3,926,778, 3,928,172, 3,974,062 and 4,116,814 (multiple risers), incorporated herein by reference.

Several of these processes employ a mixture of catalysts having different catalytic properties as, for example, the catalytic cracking process described in U.S. Pat. No. 3,894,934 which utilizes a mixture of a large pore crystalline zeolite cracking catalyst such as zeolite Y and shape selective medium pore crystalline metallosilicate zeolite such as ZSM-5. Each catalyst contributes to the function of the other to produce a gasoline product of relatively high octane rating.

A fluidized catalytic cracking process in which a cracking catalyst such as zeolite Y is employed in combination with a shape selective medium pore crystalline siliceous zeolite catalyst such as ZSM-5, permits the refiner to take greater advantage of the unique catalytic capabilities of ZSM-5 in a catalytic cracking operation such as increasing octane rating.

The major conventional cracking catalysts presently in use generally comprise a large pore crystalline zeolite, generally in a suitable matrix component which may or may not itself possess catalytic activity. These zeolites typically possess an average cyrstallographic pore dimension greater than 8.0 Angstroms for their major pore opening. Representative crystalline zeolite cracking catalysts of this type include zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), synthetic mordenite, dealuminized synthetic mordenite, merely to name a few, as well as naturally occurring zeolites such as chabazite, faujasite, mordenite, and the like. Also useful are the silicon-substituted zeolites described in U.S. Pat. No. 4,503,023.

It is, of course, within the scope of this invention to employ two or more of the foregoing large pore crystalline cracking catalysts. Preferred large pore crystalline zeolite components of the mixed catalyst composition herein include the synthetic faujasite zeolites X and Y with particular preference being accorded zeolites Y, REY, USY and RE-USY.

The shape selective medium pore crystalline zeolite catalyst can be present in the mixed catalyst system over widely varying levels. For example, the zeolite of the second catalyst component can be present at a level as low as about 0.01 to about 1.0 weight percent of the total catalyst inventory (as in the case of the catalytic cracking process of U.S. Pat. No. 4,368,114) and can represent as much as 25 weight percent of the total catalyst system.

The catalytic cracking unit is preferably operated under fluidized flow conditions at a temperature within the range of from about 480° C. to about 735° C., a first catalyst component to charge stock ratio of from about 2:1 to about 15:1 and a first catalyst component contact time of from about 0.5 to about 30 seconds. Suitable charge stocks for cracking comprise the hydrocarbons generally and, in particular, petroleum fractions having an initial boiling point range of at least 205° C., a 50% point range of at least 260° C. and an end point range of at least 315° C. Such hydrocarbon fractions include gas oils, thermal oils, residual oils, cycle stocks, whole top crudes, tar sand oils, shale oils, synthetic fuels, heavy hydrocarbon fractions derived from the destructive hydrogenation of coal, tar, pitches, asphalts, hydrotreated feedstocks derived from any of the foregoing, and the like. As will be recognized, the distillation of higher boiling petroleum fractions above about 400° C. must be carried out under vacuum in order to avoid thermal cracking. The boiling temperatures utilized herein are expressed in terms of convenience of the boiling point corrected to atmospheric pressure.

Olefins Oligomerization Reactor Operation

A typical olefins oligomerization reactor unit employs a temperature-controlled catalyst zone with indirect heat exchange and/or fluid gas quench, whereby the reaction exotherm can be carefully controlled to prevent excessive temperature above the usual operating range of about 200° C. to 400° C., preferably at average reactor temperature of 280° C. to 350° C. The alkene conversion reactors operate at moderate pressure of about 100 to 10000 kPa, preferably 1000 to 6000 kPa.

The weight hourly space velocity (WHSV), based on total olefins in the fresh feedstock is about 0.5–80 WHSV.

The use of a fluid-bed reactor in this process offers several advantages over a fixed-bed reactor. Due to catalyst withdrawal and makeup, fluid-bed reactor operation will not be adversely affected by oxygenate, sulfur and/or nitrogen containing contaminants present in FCC fuel gas. In addition, the reactor temperature can be controlled to stay constant which allows optimizing the desired product yields. One of the most valuable products of the above-described reaction is iso-butene which can be upgraded to MTBE.

The reaction temperature can be controlled by adjusting the feed temperature so that the enthalpy change balances the heat of reaction. The feed temperature can be adjusted by a feed preheater, heat exchange between the feed and the product, or a combination of both. Once the feed and product compositions are determined using, for example, an on-line gas chromatograph, the feed temperature needed to maintain the desired reactor temperature, and consequent olefin conversion, can be easily predetermined from a heat balance of the system. In a commercial unit this can be done automatically by state-of-the-art control techniques.

A typical light gas feedstock to the olefins oligomerization reactor contains $C_2$–$C_6$ alkenes (mono-olefin), usually including at least 2 mole % ethene, wherein the total $C_2$–$C_3$ alkenes are in the range of about 10 to 40 wt. %. Non-deleterious components, such as hydrogen, methane and other paraffins and inert gases, may be present. The preferred feedstock is a $C_3$–$C_4$ by-product of FCC gas oil cracking units containing typically more than 35% olefins. The process may be tolerant of a wide range of lower alkanes, from 0 to 95%. Preferred feedstocks contain more than 50 wt. % $C_1$–$C_4$ lower aliphatic hydrocarbons, and contain sufficient olefins to provide total olefinic partial pressure of at least 50 kPa.

The desired products are olefinic $C_4$ to $C_9$ hydrocarbons, which will comprise at least 70 wt. % of the net product, preferably 95% or more. Olefins may comprise a predominant fraction of the $C_4$+ reaction effluent. It is desired to minimize paraffins and aromatics production, preferably to less than 8% and 2% by weight, respectively.

The reaction severity conditions can be controlled to optimize yield of $C_4$–$C_9$ olefinic hydrocarbons. It is understood that aromatics and light paraffin production is promoted by those zeolite catalysts having a high concentration of Bronsted acid reaction sites. Accordingly, an important criterion is selecting and maintaining catalyst inventory to provide either fresh catalyst having acid activity or by controlling catalyst deactivation rate to provide a low apparent average alpha value of about 1 to 10.

Reaction temperatures and contact time are also significant factors in the reaction severity, and the process parameters are followed to give a substantially steady state condition wherein the reaction severity index (R.I.) is maintained within the limits which yield a desired weight ratio of paraffins to olefins propene. While this index may vary from about 0.04 to 200, it is required to operate the steady state fluidized bed unit to hold the R.I. at about 0.04:1 to 4.0:1 preferably 0.04:1 to 0.09:1.

In the continuous operation of the oligomerization stage, fresh catalyst having a relatively high alpha value is added to the catalyst bed to maintain the required catalyst activity. A small amount of catalyst can be periodically withdrawn from the reaction zone, said catalyst having up to about 7% coke deposited thereupon, and is sent to the FCC reactor where part of the coke is upgraded and the catalyst voids and pores are stripped The rest of the coke is burned in the FCC regenerator.

The procedure of withdrawing catalyst and adding a similar amount of fresh catalyst can be performed either continuously or at periodic intervals throughout the operation of the oligomerization stage.

The composition of the withdrawn catalyst is heterogeneous. The withdrawn catalyst, called partially deactivated or equilibrium catalyst, comprises fresh catalyst particles having a high alpha value, permanently deactivated catalyst particles having a low alpha value, and catalyst particles at various stages of deactivation having alpha values in the range between fresh and permanently deactivated catalyst particles. Although each of the particles in any sample of equilibrium catalyst has its own alpha value, the entire sample has an "average" alpha value. In the present process, equilibrium catalyst has an average alpha value of about 1–10.

Particle size distribution can be a significant factor in achieving overall homogeneity in turbulent regime fluidization. It is desired to operate the process with particles that will mix well throughout the bed. Large particles having a particle size greater than 250 microns should be avoided, and it is advantageous to employ a particle size range consisting essentially of 1 to 150 microns. Average particle size is usually about 20 to 100 microns, preferably 40 to 80 microns. Particle distribution may be enhanced by having a mixture of larger and smaller particles within the operative range, and it is particularly desirable to have a significant amount of fines. Close control of distribution can be maintained to keep about 10 to 25 wt % of the total catalyst in the reaction zone in the size range less than 32 microns. This class of fluidizable particles is classified as Geldart Group A. Accordingly, the fluidization regime is controlled to assure operation between the transition velocity and transport velocity. Fluidization conditions are substantially different from those found in non-turbulent dense beds or transport beds.

Developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolitic framework. These medium pore zeolites are favored for acid catalysis; however, the advantages of ZSM-5 structures may be utilized by employing highly siliceous materials or cystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The metallosilicate catalysts useful in the process of this invention may contain a siliceous zeolite generally known as a shape-selective ZSM-5 type. The members of the class of zeolites useful for such catalysts have an effective pore size of generally from about 5 to about 7 Angstroms such as to freely sorb normal hexane. In addition, the structure provides constrained access to larger molecules. A convenient measure of the extent to which a zeolite provides control to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g. less than 7 Angstroms. Large pore zeolites which provide relatively free access to the internal zeolite structure have a low value for the Constraint Index, and usually have pores of large size, e.g. greater than 8 Angstroms. The method by which Constraint Index is determined is described fully in U.S. Pat. No. 4,016,218,(Haag et al) incorporated herein by reference for details of the method.

The class of siliceous medium pore zeolites defined herein is exemplified by ZSM-5, ZSM-11, ZSM-12, ZSM-22, ZSM-23, ZSM-35, ZSM-38, ZSM-48, and other similar materials. ZSM-5 is described in U.S. Pat. No. 3,702,886 (Argauer et al); ZSM-11 in U.S. Pat. No. 3,709,979 (Chu); ZSM-12 in U.S. Pat. No. 3,832,449 (Rosinski et al); ZSM-22 in U.S. Pat. No, 4,046,859 (Plank et al); ZSM-23 in U.S. Pat. No. 4,076,842 (Plank et al); ZSM-35 in U.S. Pat. No. 4,016,245 (Plank et al); ZSM-38 in U.S. Pat. No. 4,046,859 (Plank et al); and ZSM-48 in U.S. Pat. No. 4,397,827 (Chu). The disclosures of these patents are incorporated herein by reference. While suitable zeolites having a coordinated metal oxide to silica molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt. % silica and/or alumina binder.

These siliceous zeolites may be employed in their acid forms ion exchanged or impregnated with one or more suitable metals, such as Ga, Pd, Zn, Ni Co and/or other metals of Periodic Groups III to VIII. The zeolite may include a hydrogenation-dehydrogenation component (sometimes referred to as a hydrogenation component) which is generally one or more metals of group IB, IIB, IIIB, VA, VIA or VIIIA of the Periodic Table (IUPAC), especially aromatization metals, such as Ga, Pd, etc. Useful hydrogenation components include the noble metals of Group VIIIA, especially platinum, but other noble metals, such as palladium, gold, silver, rhenium or rhodium, may also be used. Base metal hydrogenation components may also be used, especially nickel, cobalt, molybdenum, tungsten, copper or zinc. The catalyst materials may include two or more catalytic components, such as a metallic oligomerization component (e.g., ionic $Ni^{+2}$, and a shape-selective medium pore acidic oligomerization catalyst, such as ZSM-5 zeolite) which components may be present in admixture or combined in a unitary bifunctional solid particle. It is possible to utilize an ethene dimerization metal or oligomerization agent to effectively convert feedstock ethene in a continuous reaction zone.

Certain of the ZSM-5 type medium pore shape selective catalysts are sometimes known as pentasils. In addition to the preferred aluminosilicates, the borosilicate, ferrosilicate and "silicalite" materials may be employed. It is advantageous to employ a standard ZSM-5 having a silica:alumina molar ratio of 25:1 to 70:1 with an apparent alpha value of 1–10 to convert 60 to 100 percent, preferably at least 70%, of the olefins in the feedstock to $C_5$+ hydrocarbons.

Usually the zeolite crystals have a crystal size from about 0.01 to over 2 microns or more, with 0.02–1 micron being preferred. In order to obtain the desired particle size for fluidization in the turbulent regime, the zeolite catalyst crystals are bound with a suitable inorganic oxide, such as silica, alumina, clay, etc. to provide a zeolite concentration of about 5 to 95 wt. %. In the description of preferred embodiments a 25% H-ZSM-5 catalyst contained within a silica-alumina matrix and having a fresh alpha value of about 80 is employed unless otherwise stated.

The Integrated System

The continuous multi-stage process disclosed herein successfully integrates a primary stage FCC operation and a secondary stage olefins oligomerization reaction to obtain a substantial increase in gasoline/distillate yield. When the oligomerization reaction is conducted at low severity reaction conditions, a major proportion of light olefins by-product from the FCC operation is converted to valuable hydrocarbons. The integrated process comprises contacting heavy petroleum feedstock in a primary fluidized bed reaction stage with cracking catalyst comprising particulate solid large pore acid aluminosilicate zeolite catalyst at conversion conditions to produce a hydrocarbon effluent comprising light gas containing lower molecular weight olefins, intermediate hydrocarbons in the gasoline and distillate range, and cracked bottoms; separating the light gas containing lower molecular weight olefins; reacting at least a portion of the light gas in a secondary fluidized bed reactor stage in contact with medium pore acid zeolite catalyst particles under reaction conditions to effectively convert a portion of the lower molecular weight olefins to olefinic hydrocarbons boiling in the gasoline and/or distillate range; withdrawing a portion of catalyst from the secondary fluidized bed reaction stage; and passing the withdrawn catalyst portion to the primary fluidized bed reaction stage for contact with the heavy petroleum feedstock. The FCC wash water makeup is preferably utilized to extract any impurities from the secondary stage feed. The extractor bottoms is then used as FCC wash water makeup. This eliminates the need to provide regeneration facilities for the extractor bottom stream.

In a most preferred embodiment, the process comprises: maintaining a primary fluidized bed reaction stage containing cracking catalyst comprising a mixture of crystalline aluminosilicate particles having an effective pore size greater than 8 Angstroms and crystalline medium pore zeolite particles having an effective pore size of about 5 to 7 Angstroms; converting a feedstock comprising a heavy petroleum fraction boiling above about 250° C. by passing the feedstock upwardly through the primary stage fluidized bed in contact with the mixture of cracking catalyst particles under cracking conditions of temperature and pressure to obtain a product stream comprising intermediate and lower boiling hydrocarbons; separating the product stream to produce olefinic light gas, intermediate products containing $C_3$–$C_4$ olefins, gasoline and distillate range hydrocarbons, and a bottoms fraction; maintaining a secondary fluidized bed reaction stage containing light olefins conversion catalyst comprising crystalline medium pore acid zeolite particles having an average alpha value of about 1–10 and an effective pore size of about 5 to 7 Angstroms; contacting at least a portion of $C_3$–$C_4$ olefins (the FCC $C_4$'s may be partially etherified upstream of this reactor) with particles in the secondary fluidized bed reaction stage under reaction severity conditions to obtain etherifiable iso-butene, iso-pentenes and olefinic gasoline and/or distillate product; withdrawing from the secondary stage a portion of catalyst particles having preferably at least 3.1% coke content; and adding the zeolite catalyst particles to the primary fluidized bed reaction stage for admixture with the cracking catalyst. At least a portion of the FCC ethene rich gas can be added to the $C_3$–$C_4$ olefins prior to contact with light olefins conversion catalyst in the secondary stage. Additional fresh catalyst having a pore size of 5 to 7 Angstroms can be admixed with the catalysts added to the first stage.

It is not necessary for the practice of the present process to employ as feedstock for the olefins oligomerization reaction zone the light olefins from the integrated FCC unit. It is contemplated that any feedstock containing lower molecular weight olefins can be used, regardless of the source.

It has also been found that heavy petroleum feedstocks can be more easily and efficiently converted to valuable hydrocarbon products by using an apparatus comprising a multi-stage continuous fluidized bed catalytic reactor system which comprises primary reactor means for contacting feedstock with a fluidized bed of solid catalyst particles under cracking conditions to provide liquid hydrocarbon product and reactive hydrocarbons; primary catalyst regenerator means operatively connected to receive a portion of catalyst from the primary reactor means for reactivating said catalyst portion; primary activated catalyst handling means to conduct at least a portion of reactivated catalyst from the primary regenerator means to the primary reactor means; means for recovering a reactive hydrocarbon stream; second reactor means for contacting at least a portion of the reactive hydrocarbons under low severity conversion conditions with a fluidized bed of solid catalyst particles to further convert reactive hydrocarbons to additional liquid hydrocarbon product and thereby depositing by-product coke onto the catalyst particles. Catalyst handling means is provided to conduct a portion of the reactor catalyst from the secondary reactor means to the primary reactor means for further heavy petroleum feedstock conversion use.

FIG. 1 illustrates a process scheme for practicing the present invention. The flow of chemicals beginning with the heavy hydrocarbons feed at line 1 is schematically represented by solid lines. The flow of catalyst particles is represented by dotted lines. Chemical feedstock passes through conduit 1 and enters the first stage fluidized bed cracking reactor 10. The feed can be charged to the reactor with a diluent such as hydrocarbon or steam. Deactivated catalyst particles are withdrawn from fluidized bed reaction zone 10 via line 3 and passed to catalyst regeneration zone 40, where the particles having carbonaceous deposits thereon are oxidatively regenerated by known methods. The regenerated catalyst particles are then recycled via line 5 to reaction zone 10. Catalyst is withdrawn from the regenerator via line 41.

A portion of secondary stage catalyst is sent via conduit 37 to first fluid bed reaction zone 10. Fresh medium pore zeolite catalyst can be admixed with the regenerated catalyst as by conduit 39. Also, fresh medium pore zeolite catalyst is added to olefins upgrading reaction zone 30 via conduit 20.

Cracked product from the FCC reaction zone 10 is withdrawn through conduit 2 and passed to a main fractionation tower 4 where the product is typically separated into a light gas stream, a middle stream, and a bottoms stream. The middle stream is recovered via conduit 12 and the bottoms stream is withdrawn through conduit 11. The light gas stream is withdrawn through conduit 6 and enters gas plant 8 for further separation. A middle fraction is drawn from the gas plant via conduit 14 and a heavy fraction is withdrawn via conduit 13. A stream comprising lower olefins is withdrawn via conduit 7 and enters high severity olefins oligomerization unit 30 where the stream contacts siliceous medium pore zeolite catalyst particles in a turbulent regime fluidized bed to form a hydrocarbon product rich in $C_5$+ hydrocarbons boiling in the gasoline and/or distillate range. The hydrocarbon product is removed from the olefins oligomerization zone 30 through conduit 9 for further processing.

The catalyst inventory in the FCC reactor preferably comprises zeolite Y which is impregnated with one or more rare earth elements (REY). This large pore cracking catalyst is combined in the FCC reactor with the ZSM-5 withdrawn from the oligomerization reactor catalyst regeneration zone to obtain a mixed FCC cracking catalyst which provides a gasoline yield having improved octane number and an increased yield of lower molecular weight olefins which can be upgraded in the oligomerization reactor or an alkylation unit (not shown).

Advantageously, the catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5–100 percent by weight of partially deactivated zeolite catalyst based on total amount of catalyst present in the secondary reaction stage is withdrawn from the secondary reaction stage and added to the primary fluidized bed reaction stage to increase octane by 0.2–2 Research (base 92 Research).

Catalyst inventory in the fluidized catalytic cracking unit may be controlled so that the ratio of cracking catalyst to the added zeolite oligomerization catalyst is about 5:1 to about 20:1. In a preferred example the zeolite oligomerization catalyst has an apparent acid cracking value of about 1 to 10 when it is withdrawn from the fluidized bed olefins oligomerization unit for recycle to the FCC unit. The fresh medium pore catalyst for the olefins oligomerization unit and the FCC unit has an apparent acid cracking value about 80 and above.

In a preferred example, the total amount of fluidized catalyst in the FCC reactor is about ten times as much as the amount of fluidized catalyst in the oligomerization reactor. To maintain equilibrium catalyst activity in the FCC reactor, fresh Y zeolite catalyst particles are added in an amount of about 1 to 2 percent by weight based on total amount of catalyst present in the FCC reactor. Spent cracking catalyst is then withdrawn for subsequent disposal from the FCC reactor in an amount substantially equivalent to the combination of fresh REY zeolite catalyst and partially deactivated ZSM-5 catalyst which is added to the reactor.

In a typical example of the present process, an FCC reactor is operated in conjunction with an olefins oligomerization reactor (vide supra). The catalyst flow rates per day are adjusted so that about 1.25 percent by weight of fresh large pore zeolite cracking catalyst based on total amount of catalyst present in the FCC reactor is added to the FCC reactor; about 30.0 percent by weight fresh zeolite ZSM-5 catalyst based on total amount of catalyst present in the olefins oligomerization reactor is added to the olefins oligomerization reactor; and about 30.0 percent by weight of zeolite ZSM-5 catalyst based on total amount of catalyst present in the olefins oligomerization reactor is withdrawn from the olefins oligomerization reactor, and added to the catalyst inventory of the FCC reactor. The gasoline range hydrocarbons obtained from the FCC reactor have an increased octane rating (using the (R+M)/2 method, where R=research octane number and M=motor octane number) of 0.7. The distillate range hydrocarbons obtained directly or after further high pressure oligomerization from the olefins oligomerization reactor typically have a cetane rating of 52 after hydrotreating.

While the invention has been described by reference to certain embodiments, there is no intent to limit the inventive concept except as set forth in the following claims.

I claim:

1. A continuous multi-stage process for increasing octane quality and yield of liquid hydrocarbons from an integrated fluidized catalytic cracking unit and olefins oligomerization reaction zone comprising:

contacting heavy hydrocarbon feedstock in a primary fluidized bed reaction stage with cracking catalyst comprising particulate solid large pore acid aluminosilicate zeolite catalyst at conversion conditions to produce a hydrocarbon effluent comprising gas containing $C_2$–$C_6$ olefins, intermediate hydrocarbons in the gasoline and distillate range, and cracked bottoms;

regenerating the primary stage zeolite cracking catalyst in a primary stage regeneration zone and returning at least a portion of the resulting regenerated zeolite cracking catalyst to the primary reaction stage;

withdrawing another portion of said catalyst from said regeneration zone and adding fresh makeup catalyst thereto;

separating primary stage effluent to recover olefinic gas containing $C_2$–$C_6$ olefins;

reacting at least a portion of the olefinic gas in a secondary fluidized bed reactor stage in contact with a closed fluidized bed of acid zeolite catalyst particles consisting essentially of medium pore shape selective zeolite under low severity oligomerization reaction conditions to effectively convert $C_2$–$C_6$ olefins to heavier hydrocarbons boiling in the gasoline and/or distillate range, said low sensitivity conditions comprising temperature of about 200° C. to 400° C., pressure of about 100 to 10000 kPa and weight hourly space velocity of about 0.5 to 80 WHSV as based on total olefins in the fresh feedstock;

adding fresh acid medium pore zeolite particles to the secondary stage reactor in an amount sufficient to maintain average equilibrium catalyst particle activity for effective oligomerization reaction without regeneration of the secondary catalyst bed;

withdrawing a portion of equilibrium catalyst from the secondary fluidized bed reactor stage; and passing said withdrawn catalyst portion to the primary fluidized bed reaction stage for contact with the petroleum feedstock, said withdrawn catalyst passed at a rate sufficient to maintain the ratio of cracking catalyst to equilibrium catalyst in said primary reaction stage between about 5:1 and 20:1.

2. A process according to claim 1 wherein equilibrium catalyst withdrawn from the second fluidized bed reaction stage is in partially deactivated form and has an average alpha value of about 1 to 10; and wherein reaction severity conditions are maintained to obtain oligomerization effluent having a molar ratio or reactivity index of propane to propene in the range of 0.04:1 to 4.0:1.

3. A process according to claim 2 including the step of washing the olefinic feed from the primary reaction stage to remote water-soluble impurities prior to contacting medium pore catalyst in the secondary reaction stage.

4. A process according to claim 3 wherein said medium pore zeolite is ZSM-5 and wherein equilibrium catalyst has deposited thereon up to about 7 wt % of coke.

5. A process according to claim 1 wherein fresh catalyst having an average alpha value of at least about 80 is added to the second fluidized bed reaction stage to maintain acid activity of the equilibrium catalyst, and wherein the reaction severity provides an R.I. of about 0.04 to 0.09.

6. A continuous multi-stage process for increasing production of high octane gasoline range hydrocarbons from crackable petroleum feedstock comprising:

contacting the feedstock in a primary fluidized catalyst reaction stage with a mixed catalyst system which comprises finely divided particles of a first large pore cracking catalyst component and finely divided particles of a second medium pore siliceous zeolite catalyst component under cracking conditions to obtain a product comprising intermediate gasoline and distillate range hydrocarbons; and an olefinic gas rich in $C_2$–$C_4$ olefins;

separating the olefinic gas from the product and containing said olefinic gas with particulate catalyst solids consisting essentially of medium pore siliceous zeolite catalyst in a secondary fluidized bed reaction stage under low severity reaction conditions effective to upgrade said olefinic gas to predominantly $C_5$+ hydrocarbons while producing propane and propene in a molar ratio of about 0.04:1 to 4.0:1, thereby depositing about 3–7 wt % carbonaceous material onto the particulate zeolite catalyst to obtain a coked equilibrium catalyst, said low severity conditions comprising temperature of about 200° C. to 400° C., pressure of about 100 to 10000 KPa and weight hourly space velocity of about 0.5 to 80 WHSV as based on total olefins in the fresh feedstock;

withdrawing a portion of partially deactivated equilibrium particulate zeolite catalyst from the secondary reaction stage; and adding said withdrawn coked equilibrium zeolite catalyst to the primary fluidized reaction stage for conversion of crackable petroleum feedstock, said withdrawn catalyst passed at a rate sufficient to maintain the ratio of cracking catalyst to equilibrium catalyst in said primary reaction stage between about 5:1 and 20:1 whereby catalyst makeup of the primary stage fluidized catalytic cracking unit and the secondary stage olefins conversion unit is balanced.

7. A process for integrating the catalyst inventory of a fluidized catalytic cracking unit and a fluidized bed reaction zone for the conversion of olefins to gasoline or distillate, the process comprising;

maintaining a primary fluidized bed reaction stage containing acid cracking catalyst comprising a mixture of crystalline aluminosilicate particles having a pore size greater than 8 Angstroms and crystalline medium pore zeolite particles having a pore size of about 5 to 7 Angstroms;

converting a feedstock comprising a petroleum fraction boiling above about 250° C. by passing the feedstock upwardly through the primary stage fluidized bed in contact with the mixture of cracking catalyst particles under cracking conditions of temperature and pressure to obtain a product stream comprising cracked hydrocarbons;

separating the product stream to produce olefinic gas containing $C_2$–$C_4$ olefins, intermediate products containing gasoline and distillate range hydrocarbons, and a bottoms fraction;

maintaining a secondary fluidized bed reaction stage containing finely divided olefins conversion catalyst consisting essentially of crystalline medium pore zeolite particles having an average alpha value of about 1 to 10 and a pore size of about 5 to 7 Angstroms;

contacting at least a portion of the olefinic gas with said medium pore zeolite particles in the secondary fluidized bed reaction stage under low severity reaction severity conditions to obtain olefinic gasoline or distillate product, said low severity conditions comprising temperature of about 200° C. to 400° C., pressure of about 100 to 10000 kPa and weight hourly space velocity of about 0.5 to 80 WHSV as based on total olefins in the fresh feedstock;

withdrawing from the secondary stage a portion of catalyst particles; and adding portions of the withdrawn zeolite catalyst particles to the primary fluidized bed reaction stage containing cracking catalyst said withdrawn catalyst passed at a rate sufficient to maintain the ratio of cracking catalyst to equilibrium catalyst in said primary reaction stage between about 5:1 and 20:1.

8. A process according to claim 7 wherein the catalyst flow rates per day are adjusted so that about 1 to 10 percent by weight of fresh cracking catalyst based on total amount of catalyst present in the primary fluidized bed reaction stage is added to the primary reaction stage; about 0.5 to 100 percent by weight fresh zeolite catalyst based on total amount of catalyst present in the secondary fluidized bed reaction stage is added to the secondary reaction stage; and about 0.5 to 100 percent by weight of partially deactivated zeolite catalyst based on total amount of catalyst present in the secondary reaction stage is withdrawn from the secondary reaction stage and added to the primary fluidized bed reaction stage to increase octane of the resulting gasoline stream by 0.2–2 Research octane number.

9. A process according to claim 7 wherein the ratio of propane to propene in the product obtained from the secondary fluidized bed reaction stage is about 0.04–4.0:1.

10. A process according to claim 7 wherein $C_3$–$C_4$ olefins comprise a major amount of the olefinic gas.

11. A process according to claim 7 wherein the secondary stage oligomerization reaction is conducted at a temperature of about 250° to 450° C. and at a weight hourly space velocity of about 0.5 to 80, based on total secondary fluidized catalyst weight.

12. A process according to claim 7 wherein the olefinic gas consists essentially of $C_3$–$C_4$ olefins.

13. A process according to claim 7 wherein the secondary stage oligomerization effluent consists essentially of olefinic hydrocarbons in admixture with less than 8 wt % paraffins and less than 2 wt % aromatics.

14. A process according to claim 7 wherein the secondary stage oligomerization effluent contains about 70–95 wt % $C_4$–$C_9$ olefinic hydrocarbons.

15. A process according to claim 7 wherein the secondary stage oligomerization is operated at reaction severity index R.I. less than 0.09 to provide a coke make less than 0.1% by weight of the olefinic feed at operating temperature below about 370° C.

* * * * *

UNITED STATES PATENT AND TRADEMARK OFFICE

CERTIFICATE OF CORRECTION

PATENT NO. : 5,000,837

DATED : March 19, 1991

INVENTOR(S) : Mohsen N. Harandi

It is certified that error appears in the above-identified patent and that said Letters Patent is hereby corrected as shown below:

Column 12, line 49, patent reads "sensitivity" should be --serverity--

Signed and Sealed this

Second Day of February, 1993

*Attest:*

STEPHEN G. KUNIN

*Attesting Officer*

*Acting Commissioner of Patents and Trademarks*